United States Patent [19]

Izawa

[11] 4,047,262

[45] Sept. 13, 1977

[54] DEVICE FOR INTERCONNECTING CURTAIN RODS

[76] Inventor: Takeshi Izawa, 1101, Shinmachi, Ikunocho, Asako, Hyogo, Japan

[21] Appl. No.: 645,352

[22] Filed: Dec. 30, 1975

[51] Int. Cl.[2] ..... A47H 1/04

[52] U.S. Cl. ..... 16/96 D; 16/93 D

[58] Field of Search ..... 16/96 D, 95 R, 93 D, 16/87.4 R, 87.4 W, 87.6 R, 87 B, 95 D, 96 L; 160/124, 345, 346, 344, 330; 403/393

[56] References Cited

U.S. PATENT DOCUMENTS

| | | | |
|---|---|---|---|
| 2,753,588 | 7/1956 | Grosh | 16/95 D |
| 2,757,804 | 8/1956 | Sadwin | 16/87.6 R |
| 3,491,400 | 1/1970 | Hubbard | 16/96 R |

FOREIGN PATENT DOCUMENTS

| | | | |
|---|---|---|---|
| 166,439 | 3/1934 | Switzerland | 16/87.6 R |
| 956,943 | 4/1964 | United Kingdom | 16/96 D |
| 1,058,364 | 2/1967 | United Kingdom | 16/87.4 R |

*Primary Examiner*—Andrew V. Kundrat
*Attorney, Agent, or Firm*—Armstrong, Nikaido & Marmelstein

[57] ABSTRACT

Device for eliminating a clearance at the center where a pair of curtains of the center draw type are overlapped. The device can be interposed between two straight curtain rods aligned end-to-end to detachably interconnect the curtain rods and comprises two connecting rails joined together side by side. Each of the rails includes a straight end portion to be connected to the corresponding curtain rod, a bent portion continuous with the straight end portion, and an extension continuously extending from the end of the bent portion deviated sidewise by a distance equal to the width of the rail so as to position in parallel to the straight end portion. The curtains on the opposite curtain rods are movable toward each other along the connecting rails to overlap each other at the bent portions and extensions.

4 Claims, 3 Drawing Figures

DEVICE FOR INTERCONNECTING CURTAIN RODS

BACKGROUND OF THE INVENTION

Conventionally, a pair of curtains are suspended from a staight curtain rod by carriers which are slidable on the curtain rod to join the curtains together end-to-end at the center. Accordingly the abutting ends of the curtains are liable to open and form a clearance, failing to shut out the light from outside or to obstruct the view from without.

In order to overcome this problem, the specification of British Pat. No. 8,797,750 discloses an invention wherein a straight curtain rod is employed in combination with another curtain rod having a bent end. Because of the necessity of bending the end, therefore, the proposed device is not convenient to use at the site of installation.

SUMMARY OF THE INVENTION

An object of this invention is to provide a device for interconnecting curtain rods comprising two connecting rails arranged side by side in a horizontal plane and each bent laterally by a distance corresponding to the width of the rail, so that when interposed between and joined to the curtain rods, the device permits the free ends of curtains to overlap each other.

Another object of this invention is to provide a device of the type described wherein each of the connection rails has an open outer end which can be readily joined to the end of corresponding straight curtain rod without the necessity of working the end of the curtain rod.

Other objects of this invention will become apparent from the accompanying drawings and the following detailed description.

DESCRIPTION OF THE PREFERRED EMBODIMENT

Figure 1:
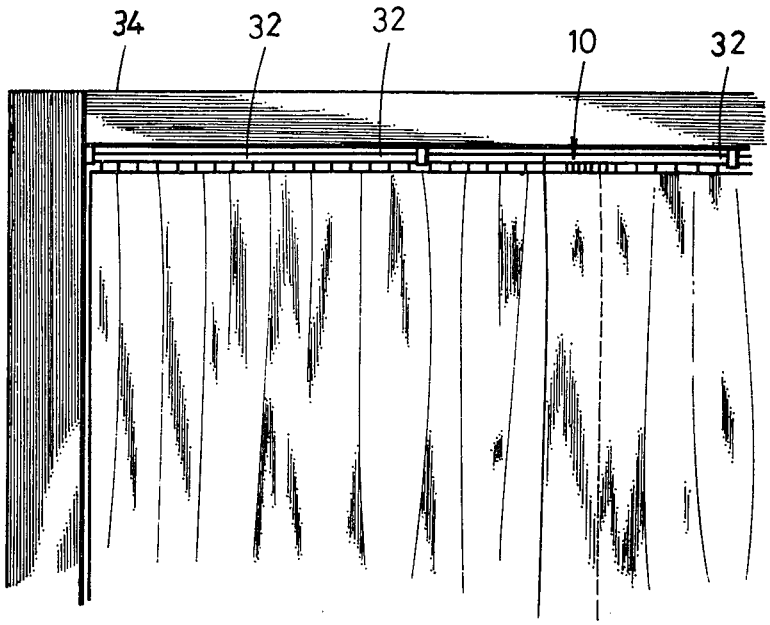
FIG. 1 is a front view showing an interconnecting device according to this invention as it is installed for use.
Figure 2:
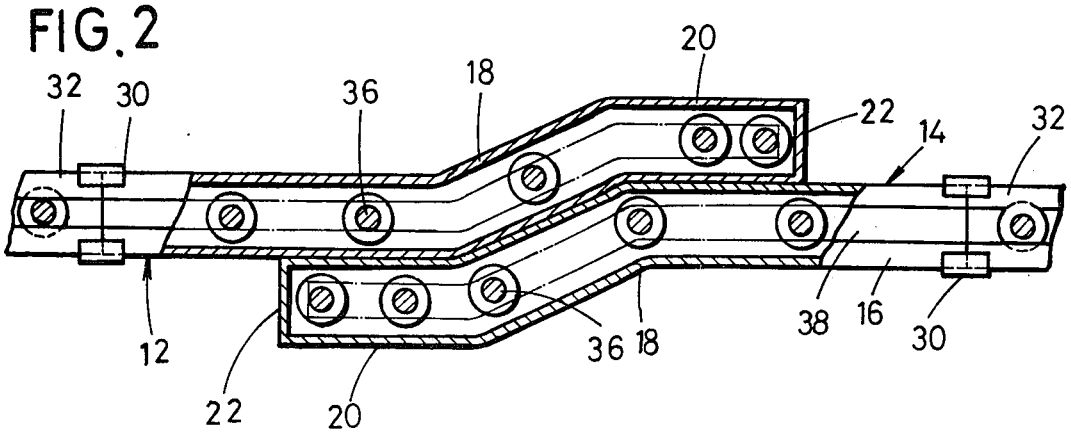
FIG. 2 is a view partly broken away and showing the device as it is seen from below.
Figure 3:
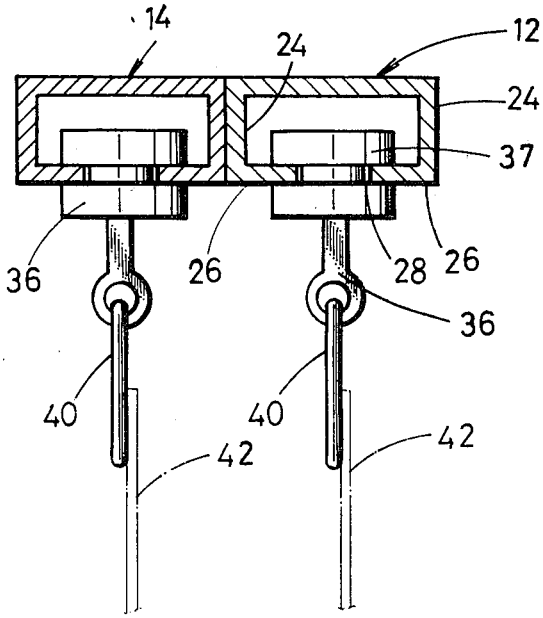
FIG. 3 is a view in section taken along the line II—II in FIG. 2.

As shown in FIG. 2, the device of this invention comprises two connecting rails 12, 14 joined together side by side and has outwardly open opposite ends to be joined to straight curtain rods respectively. The rails 12, 14 are of the same construction and each include a straight portion 16 having a straight track and an open outer end, a bent portion 18 continuous with the straight portion 16 and bent sidewise by a distance equal to the width of the rail, and an extension 20 extending straight from the bent portion in parallel to the staight portion 16 and having a stopper 22 at its terminal end. The track of each of the rails 12, 14 is formed by bending its side walls 24 inward toward each other to provide opposed support portions 26 defining therebetween an opening 28 for guiding the movement of carrier 36.

The straight curtain rods 32 is provided with a track having the same dimensions as the track of the rail 12 or 14 of the device 10. The device 10 is interposed between, and fixedly joined by connectors 30 to, the opposed ends of two staight curtain rods 32 aligned end-to-end on a widow frame 34, with the track of each of the rails 12, 14 in alignment with the track of corresponding curtain rod. The curtain 38 suspended from the carriers 36 is then movable continuously from the curtain rod 32 to the track of the device.

The carrier 36 includes at its upper end a running member 37 fitted in the opening 28 of the track and in engagement with the support portions 26 and is connected, at its lower end, to a hanger 40 attached to the curtain. The hangers 40 are equidistantly arranged on the upper hem of the curtain.

Thus when the straight curtain rods 32 are mounted on a window frame as spaced apart by a distance equal to the length of the device 10 and are then joined to the device, a curtain rail rod assembly including a junction can be readily installed in place, without any necessity of working the end of the curtain rod 32. Since the straight curtain rod needs only to be cut to a length in conformity with the width of window, the present device is very easy to install.

Other features of the advantages of this invention will be apparent to those skilled in the art. The embodiment described above can of course be modified without departing from the inventive spirit and scope as defined in the appended claims.

What is claimed is:

1. A device to be interposed between the opposed ends of two straight curtain rods aligned end-to-end for interconnecting the curtain rods, the device comprising two connecting rails joined together side by side in a horizontal plane and each having a track for guiding the movement of curtain carriers, each of the connecting rails including a straight portion having an open outer end to be connected to the corresponding straight curtain rod, a bent portion continuous with the straight portion and bent side-wise for a distance sufficient to deviate the the axis of said bent portion by the width of the rail in the horizontal plane; and an extension continuously extending from said bent portion with its axis in parallel to the axis of the straight portion and spaced apart therefrom by the width of the rail, the staight portion of each of the connecting rails being in axial alignment with the straight portion of the other connecting rail.

2. A device as defined in claim 1 wherein the extension of each of the connecting rails is provided at its terminal end with a stopper closing the end of the track thereof.

3. A device as defined in claim 2 wherein the straight portion of each of the connecting rails is provided at its outer end with a connector to be detachably joined to the end of the straight curtain rod.

4. A device as defined in claim 3 wherein the straight curtain rod has a track having the same dimensions as the track of the connecting rail.

* * * * *